US006941976B2

(12) United States Patent
Josefsson et al.

(10) Patent No.: US 6,941,976 B2
(45) Date of Patent: Sep. 13, 2005

(54) METHOD FOR CONTROLLING A YARN FEEDING DEVICE OF A WEAVING MACHINE

(75) Inventors: Paer Josefsson, Asunden (SE); Patrik Jedheimar, Moelndal (SE)

(73) Assignee: Iropa AG, Baar (CH)

( * ) Notice: Subject to any disclaimer, the term of this patent is extended or adjusted under 35 U.S.C. 154(b) by 342 days.

(21) Appl. No.: 10/239,018

(22) PCT Filed: Mar. 26, 2001

(86) PCT No.: PCT/EP01/03416

§ 371 (c)(1),
(2), (4) Date: Jan. 6, 2003

(87) PCT Pub. No.: WO01/71076

PCT Pub. Date: Sep. 27, 2001

(65) Prior Publication Data

US 2003/0140979 A1 Jul. 31, 2003

(30) Foreign Application Priority Data

Mar. 24, 2000 (DE) ..... 100 14 623

(51) Int. Cl.[7] ..... B65H 31/22
(52) U.S. Cl. ..... 139/452; 226/117; 66/132 R
(58) Field of Search ..... 139/452, 194, 139/212, 257; 226/117; 66/82 A, 825, 125 R, 132 R

(56) References Cited

U.S. PATENT DOCUMENTS

| | | | | | |
|---|---|---|---|---|---|
| 4,739,942 | A | * | 4/1988 | Maenaka | 242/365.4 |
| 5,441,087 | A | * | 8/1995 | Alberyd et al. | 139/452 |
| 5,560,556 | A | * | 10/1996 | Claesson et al. | 242/365.3 |
| 5,590,547 | A | * | 1/1997 | Conzelmann | 66/132 R |
| 5,613,528 | A | * | 3/1997 | Zenoni et al. | 139/452 |
| 5,623,973 | A | * | 4/1997 | Josefsson | 139/452 |
| 5,765,399 | A | * | 6/1998 | Huss et al. | 66/132 R |
| 6,279,619 | B1 | | 8/2001 | Halvarsson | |

FOREIGN PATENT DOCUMENTS

| | | |
|---|---|---|
| EP | 0 261 683 | 3/1988 |
| EP | 0 580 267 | 1/1994 |
| EP | 1 087 045 | 3/2001 |
| WO | WO 99/14149 | 3/1999 |

* cited by examiner

*Primary Examiner*—John J. Calvert
*Assistant Examiner*—Robert H. Muromoto, Jr.
(74) *Attorney, Agent, or Firm*—Flynn, Thiel, Boutell & Tanis, P.C.

(57) ABSTRACT

The invention relates to a method for the control of a power-loom yarn feed device, whereby a drive motor for a rotating winding element is accelerated, decelerated or stopped, on demand, for yarn storage and, in order to avoid slack yarn during the stopping of the motor, the motor is independently driven slowly during a crawl phase, such that the motor is first stopped and then after stopping is slowly rotated in the crawl phase.

7 Claims, 2 Drawing Sheets

METHOD FOR CONTROLLING A YARN FEEDING DEVICE OF A WEAVING MACHINE

BRIEF DESCRIPTION OF THE INVENTION

The present invention relates to a method of controlling a weaving machine yarn feeding device having a drive motor for driving a rotatable winding element, the drive motor when controlled to stop being further driven at slow speed independent from yarn consumption in a winding direction during a crawl phase for a predetermined time or angle.

BACKGROUND OF THE INVENTION

According to a method known from EP 05 80 267 A the drive motor of the yarn feeding and measuring device first is strongly decelerated to the low speed of the crawl phase and then is rotated further at slow speed for a predetermined rotation angle or a predetermined time duration and then is stopped at the end of the crawl phase to prevent the formation of loops in the yarn between the storage bobbin and the winding element. The strong deceleration of the drive motor and the inertia of the yarn result in a relaxation of the yarn between the storage bobbin and the winding element which relaxation may lead to a loop formation. This danger is particularly high when the drive motor is decelerated very strongly from high or maximum speed. During the subsequent restart of the drive motor depending on consumption the yarn is stretched abruptly which might cause a yarn breakage. The crawl phase directly continuing the deceleration phase either prevents that a loop will be formed or stretches an already formed loop.

According to the method known from EP 02 61 683 A a crawl phase directly continues a deceleration of the drive motor of the yarn feeding device down to crawl speed which crawl phase then is carried on for e.g. 200 ms. The purpose of the crawl phase is to prevent the occurrence of kinks in the yarn between the winding element and the storage surface, or to suppress slackness of the yarn in this area which may be caused by a backturn motion of the winding element counter to the normal winding direction.

Both known methods are based on the task either to suppress a loop formation occurring with the deceleration of the drive motor or to remove a loop already prior to the stop of the winding element. The crawl phase conventionally is controlled by a software pre-adaptation of the control device, however, by doing so it may be complicated to determine the start of the crawl phase precisely enough with the still running drive motor, since the drive motor may have differing run out phases depending on the operational conditions and the yarn quality, respectively. To assure that during the crawl phase a sufficient yarn length is pulled into the yarn feeding device, the crawl phase is adjusted for security reasons longer than necessary. For weaving machines operating with high insertion frequencies and extremely high yarn speeds in the yarn feeding device, however, it is important to stop the drive motor as rapidly as possible, in case that the number of windings stored in the yarn feeding device reaches the maximum and when at the same time no yarn consumption takes place. A crawl phase, which, however, is too long for safety reasons easily may result in an overfilling of the yarn feeding device. The static friction to start the yarn from stand still must be overcome in any case for a restart and also the static start friction in the drive motor.

It is an object of the invention to provide a method of the kind as disclosed herein which allows a correct yarn control at the inlet side of a weaving machine yarn feeding device in a simple and different manner.

The invention is considering the recognition that a relaxation of the incoming yarn during deceleration of the drive motor first neither is particularly critical for the yarn nor for the yarn feeding device or the weaving machine downstream of the yarn feeding device, but only is critical for the subsequent re-start. The yarn relaxation occurs due to the inertia or the elasticity of the yarn. Bearing this recognition in mind, the crawl phase for a predetermined rotation angle or a predetermined time duration thus is carried out after the stand still condition and so to speak in peace. For that reason, according to the method, first the drive motor is brought to stand still completely, and particularly because of the danger of an overfilling as rapidly as possible, and then the time duration available between the stand still condition and the subsequent re-start depending on consumption is utilised to carry out the crawl phase for the precise time duration or the exactly needed rotation angle, respectively. This is simpler in terms of control technique. Experience has namely proven that always a sufficiently long time duration will be available after the drive motor has been stopped from high speed. A yarn relaxation is tolerated intentionally, which might be caused by inertia, by a backturn motion of the winding element due to the yarn tension, or for other reasons, in order to first assure a rapid stop of the drive motor and to avoid overfilling of the yarn feeding device, and a measure is started first at a later point in time to omit the potential dangers of a formed loop which was particularly dangerous for the subsequent re-start.

According to the method the crawl phase is carried out for a predetermined time duration and with a predetermined speed timewise between a stand still depending on consumption and the subsequent re-start also depending on consumption or yarn demand. In this case the crawl phase speed either may be constant or variable.

Particularly, the weaving pattern during a multi-colour weaving operation may dictate longer stop pauses for a yarn feeding device feeding a certain colour. In the case that the yarn tends to relax during a longer pause, e.g. by pulling back the winding element counter to the normal winding direction, it may be expedient to associate the crawl phase timewise not to the braking phase but to the re-start, i.e., to carry out the crawl phase first immediately prior to the subsequent re-start such that a correct yarn control is guaranteed when the drive motor is restarted.

In this case it may be expedient to adjust the timewise termination of the crawl phase exactly to the point in time or even shortly after the point in time of the subsequent re-start. This may result in the advantage that the incoming yarn still may be in motion during the subsequent re-start and has not reached a condition in which the yarn or the winding element, respectively, has to overcome static starting friction. A sliding transition from the crawl phase with optionally increasing speed into the subsequent re-start is particularly advantageous for delicate yarn qualities. In this case no static starting friction has to be overcome in the drive motor as well such that the drive motor may accelerate more forcefully.

The re-start phase of the drive motor basically may contain the previous crawl phase in order to fully accelerate without stand still already from the crawl phase speed. Such a combined re-start phase e.g. is triggered by the consumption depending start signal for the drive motor and is then made by a corresponding control routine. In this case the crawl phase does not need to be controlled separately. There is no static starting friction which has to be overcome. The drive motor can be accelerated more efficiently.

Basically it is expedient to know the point in time of the subsequent and consumption depending re-start in order to precisely adapt the crawl phase thereto. This is achieved according to a further variant of the method by providing weaving pattern dependent information and to transmit the same to the control device, the information indicating at which point in time or at which rotation angle value, e.g. of the driving,shaft of the weaving machine or after how many upcoming insertion cycles the driving motor of this yarn feeding device again has to re-start. On the basis of this information the crawl phase can be carried out precisely and optimally, particularly also such that a sliding transition will take place from the crawl phase into the consumption depending subsequent re-start.

By this pre-information of the control device of the yarn feeding device a prerequisite is set for adjusting the time-wise termination of the crawl phase even shortly before, precisely on or shortly after the point in time at which the consumption depending subsequent re-start will take place. This allows not only to effect a sliding transition into the subsequent re-start, but even allows to adjust the crawl phase precisely such that then only so much yarn is pulled into the yarn feeding device sufficient to compensate for a potential loop formation.

BRIEF DESCRIPTION OF THE DRAWINGS

Embodiments of the object of the invention will be explained with the help of the drawings. In the drawings.

DETAILED DESCRIPTION

Figure 1:
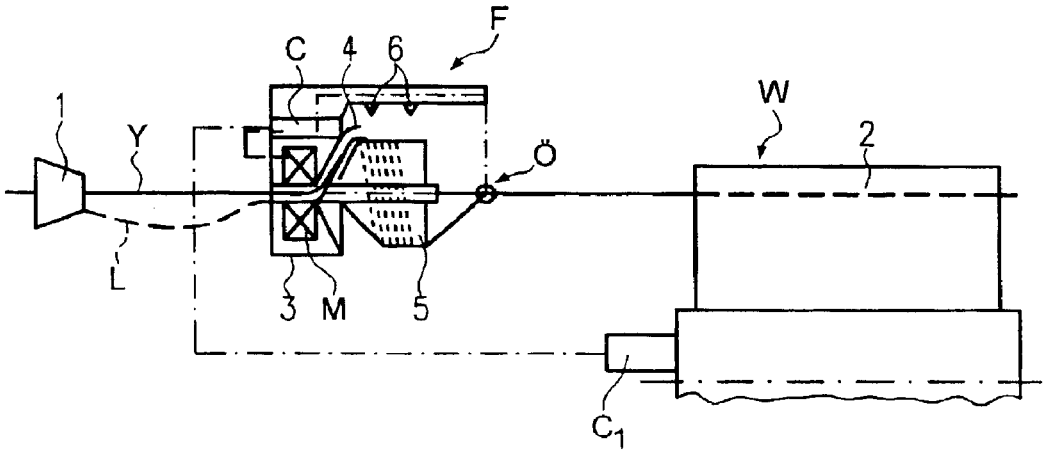
FIG. 1 is a schematic view of a yarn processing system which includes as basis components a yarn store, a weaving machine—feeding device and a weaving machine.

A yarn processing system S includes in FIG. 1 a yarn store 1, e.g. a storage bobbin, for a yarn Y wound on the storage bobbin, a yarn feeding device F which pulls off the yarn Y from the yarn store 1 and intermediately stores the yarn in windings, and a yarn processing textile machine, e.g. a weaving machine W in the form of a gripper weaving machine or a projectile weaving machine or an air jet weaving machine or a water jet weaving machine, into the weaving shed 2 of which the yarn Y intermittently is inserted as the weft yarn during subsequent discrete insertion cycles. FIG. 1 only shows one yarn feeding device F. However, several yarn feeding devices F may be functionally associated to the weaving machine W which several yarn feeding devices F may be operated according to a predetermined sequence or depending from the weaving pattern.

The yarn feeding device F contains in a housing 3 an electric drive motor M for a winding element 4. In the figure the incoming yarn Y is entering the winding element 4 from the left side and substantially linearly. The winding element 4 deflects the yarn Y outwardly and intermediately stores the yarn Y in adjacent yarn windings on a storage body 5. In the shown embodiment of the yarn feeding device the storage body 5 is provided stationarily. The yarn, optionally via a central withdrawal eyelet O, is withdrawn from the storage body 5 by a not shown insertion device of the weaving machine W. Instead the yarn feeding device may be provided with a rotatably driven storage body. This respective yarn feeding device F is intended for use at a gripper weaving machine or a projectile weaving machine, or may be designed as a measuring-feeding device for an air jet weaving machine or a water jet weaving machine, respectively.

An electronic control device C is associated to the drive motor M, and e.g. is arranged in housing 3. The control device C is connected to sensors 6 sensing the number of windings or the size of the intermediate store on the storage body 5 and transmitting corresponding signals to the control device C which re-starts the electric motor M consumption depending or depending on yarn demand. The control device C accelerates the drive motor, controls a predetermined speed, decelerates or even brakes and stops the drive motor and keeps the drive motor stopped during consumption depending on resting periods. As soon as the number of windings on the storage body 5 reaches a predetermined maximum value while the drive motor runs at maximum speed in a predetermined winding direction, the number of windings is detected by the frontside sensor. Then the drive motor has to be stopped as rapidly as possible. In case that, due to consumption, the number of windings on the storage body 5 drops below a predetermined number, the other sensor responds such that the control device C either accelerates the still running drive motor M or accelerates the drive motor M from standstill and with a predetermined characteristic of the acceleration or the re-start, respectively. Furthermore, the control device C may be programmed such that it subsequently adjusts a substantially continuous speed of the drive motor just sufficient to continuously replenish the consumption by the weaving machine w without stand still periods. In case of a so-called multi-colour weaving process with several yarn feeding devices F there might be frequently longer stand still periods for some of the yarn feeding devices depending on the weaving pattern.

FIG. 1 indicates a control assembly C1 which may be associated to the weaving machine W and which provides weaving pattern depending information which, expediently, may be transmitted to the control device C of the yarn feeding device. Such information e.g. may indicate the respective yarn feeding device F that after expiration of a predetermined time or a number of insertion cycles after transmission of the information no further consumption or new consumption will take place for a predetermined time or during a predetermined number of insertion cycles. Then the control device C may, in order to avoid abrupt condition changes in the yarn feeding device, which could be dangerous for the yarn, carry out a special preparatory control of the drive motor M. In case that the transmitted information indicates that the yarn feeding device will be taken out of consumption in a short while, then the control device may already lower the still high speed of the drive motor in advance in order to avoid a later abrupt stop. In case that the information indicates when again strong consumption and in connection therewith a re-start under full acceleration is to be expected, then the control device may start the drive motor with slow speed and in advance to avoid a later sharp re-start jerk. It is further possible to use the transmitted pre-information to preparatorily increase or decrease the running speed of the running drive motor.

During the run of the drive motor M particularly at high running speed, the yarn Y substantially is pulled from the yarn store 1 linearly and runs in stretched condition into the winding element 4. When a response of the frontmost sensor 6 rapidly stops the drive motor M, e.g. because the number of yarn windings has reached the maximum allowable value, then the drive motor M will be forcedly braked to stop such that the maximum value will be exceeded as little as possible. Due to inertia the incoming yarn Y from the bobbin then may relax during the stop procedure such that it forms a loop L e.g. between the yarn store 1 and the winding element 4. A slack yarn section also may be produced between the winding element 4 and the storage body 5. After the drive motor stop the tension present in an elastic yarn may turn back the winding element 4 until the yarn will be relaxed as well. As soon as at a later point in time the drive motor re-starts depending on yarn consumption, such a slack yarn again will be stretched abruptly which easily results in a yarn breakage. Another danger is that loops or kinks formed due to the relaxation of the yarn during the stand still period will be transported into the windings on the storage body 5 and further even into the weaving shed 2 of the weaving machine.

To avoid such malfunctions a crawl phase with low speed is controlled during the stand still phase for the drive motor by the control device C. The crawl phase is characterised in that the drive motor is rotated at very low and constant, at varied or at increasing speed during a predetermined time duration or over a predetermined rotation angle of the winding element 4 in winding direction to reliably stretch out relaxed sections of the yarn Y between the storage 1 and the storage body 5 or to even intentionally build-up a predetermined yarn tension in those sections, respectively.

Figure 2:
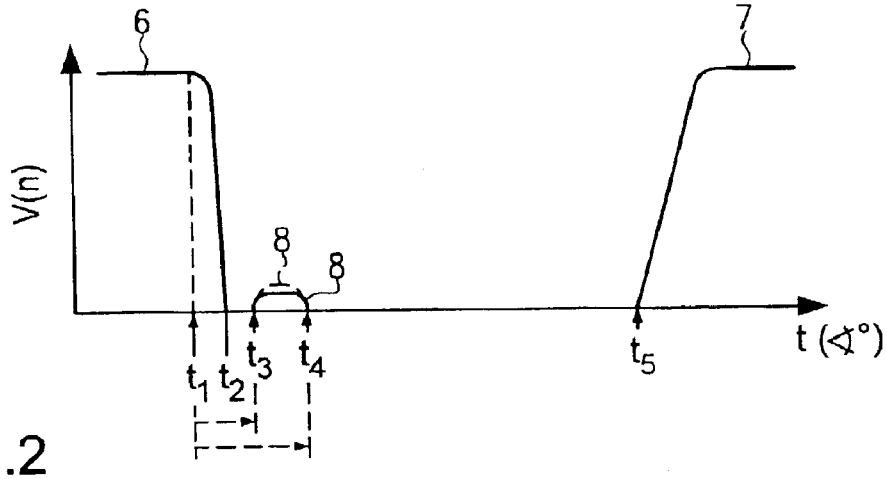
FIGS. 2–4 are speed/time diagrams related to the control operation of the yarn feeding device in different variants of the method.

According to the invention, however, the crawl phase is controlled in FIG. 2 first after the true stop of the drive motor M and of the winding element 4. The crawl phase even may be associated to the upcoming consumption depending subsequent re-start of the drive motor M.

A curve 6 shown in FIG. 2 (speed/time diagram or weaving machine rotation angle diagram) represents the run of the drive motor M at high speed before the control device C emits at a point in time t1 a command for a stop, e.g. because the frontmost sensor 6 has responded. Due to inertia the drive motor M or the winding element 4, respectively, then stop at point in time t2. At point in time t3 after t2 the crawl phase represented by a curve 8 is controlled such that the crawl phase extends over a predetermined time duration (from t5 to t4) or over a predetermined rotation range of the winding element 4. The crawl phase is made with slow speed, preferably with essentially constant or slightly varied speed. As soon as the crawl phase is terminated at point in time t4, the consumption depending subsequent re-start of the drive motor, e.g. with strong acceleration, occurs at point in time t5 (curve 7). A loop L in the yarn occurring earlier at point in time t2 or t3 then is removed during the crawl phase such that a correct yarn control will be possible during the subsequent re-start.

The control the control device C may set a predetermined time duration (t1 to t3) after the initiation of the crawl phase and at the point in time t1 of the stop signal, or the control device C may set a corresponding rotation angle range of the main shaft of the weaving machine W, respectively. The respective time duration or the rotation angle range is selected such that the individual deceleration property of the drive motor and the winding element and other components rotating therewith will be considered such that the crawl phase first starts after the true stop of the drive motor at point in time t2. It may be expedient to adjust the end (point in time t4) of the crawl phase close to the consumption depending subsequent re-start (point in time t5) to remove any relaxation of the yarn, even relaxations which occurred during a longer stand still phase. The indirect triggering action for the crawl phase is the stop signal emitted at point in time t1. Alternatively, the crawl phase could be controlled even by a cycle generator including a counter or by a clock.

In case that the yarn feeding device is operating relatively regularly with stand still periods of essentially equal durations, the control device C could carry out the crawl phase (curve 8) within each stand still period and by corresponding software preparation such that the prerequisites e.g. as shown in FIG. 2 will be fulfilled.

Figure 3:
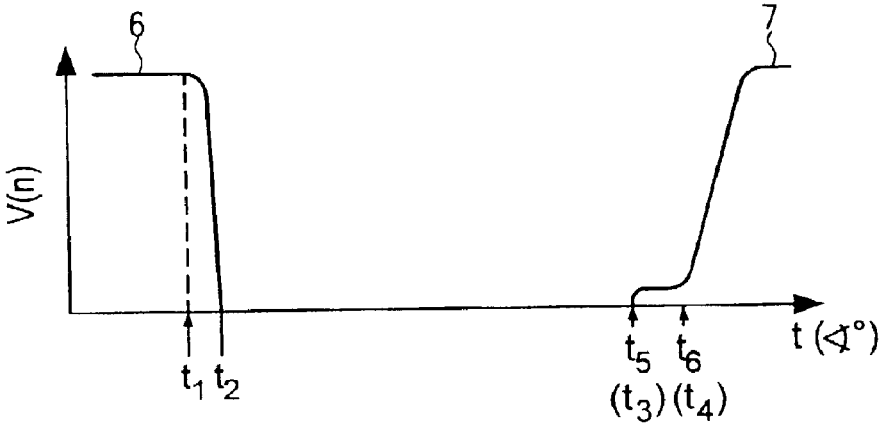

FIG. 3 the crawl phase represented by the curve 8 is integrated into the motor re-start phase such that a sliding transition is achieved from the crawl phase into a strong re-start acceleration. In this case the re-start phase of the drive motor M is set by the control such that upon-occurrence of the start signal for the drive motor at point in time t5 automatically first the crawl phase, optionally with increasing speed, is carried out and that with a sliding transition further acceleration is controlled starting at point in time t6 without an immediate stop. In this case no static starting friction of the yarn and no starting friction torque for the drive motor during the re-start have to be overcome. In other words, to the benefit of the crawl phase the strong re-start acceleration is somewhat delayed after point in time t5.

Figure 4:
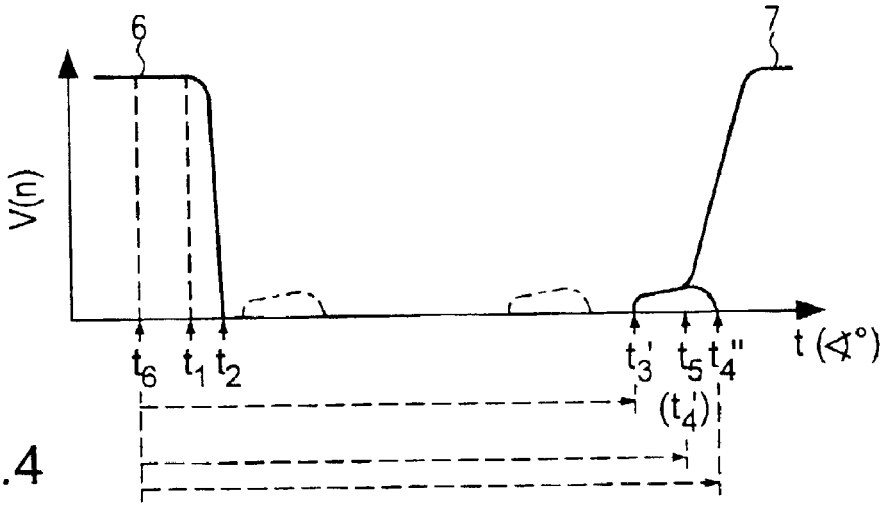

Stand still periods may have different time durations depending on consumption. For that reason and according to FIG. 4 (and as explained for control arrangement C1 in FIG. 1) information may be transmitted at a point in time t6 to control device C, e.g. from a control system monitoring the weaving pattern, that yarn consumption will cease in a short time, and that then at a later point in time t5 or shortly after t5 again yarn consumption will start from the feeding device. On the basis of this information defining the stand still phase the control device C is able to control the crawl phase such that it is carried out within the stand still period e.g. close to point in time t5 for the consumption depending re-start and such that the crawl phase either is completely carried out until then or will terminate directly at point in time t5 or even terminates with its final phase t4 overlapped with point in time t5. In both just described cases the yarn has not stopped when the drive motor re-starts (sliding transition). This means that the yarn is treated tenderly or that the drive motor can be accelerated more efficiently, respectively.

To correctly adjust the crawl phase the control device after having received the pre-information may calculate e.g. the point in time t3 (if needed even also t4', t4") substantially at point in time t1 and then controls the crawl phase accordingly.

In each case the drive motor M and the winding element 4 first are truly stopped at point in time t2, prior to initiating the crawl phase. This may be made according to routine with the help of the stop signal at point in time t1 or with the start signal at point in time t5, or individually on the basis of the pre-information.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. Method for controlling a weaving machine yarn feeding device, having a drive motor for driving a rotatable winding element in a predetermined winding direction, which winding element pulls off a yarn from a yarn storage and winds the yarn into adjacent windings on a yarn storing body, according to which method the drive motor is accelerated, decelerated or stopped by a control device depending on the yarn consumption from the windings on the storage body, the drive motor when controlled to stop being further driven at slow speed independent from yarn consumption in winding direction during a crawl phase for a predetermined time duration or over a predetermined rotational angle to remove a previously occurred yarn relaxation from the yarn between the yarn storage and the storage body, wherein the drive motor first is truly stopped at a point in time (t2), and wherein the crawl phase is initiated after the point in time (t2) of the stop in timewise or rotational angle related association either to the point in time (t2) of the stop or to the yarn consumption depending point in time (t5) of the re-start of the drive motor, respectively.

2. Method as in claim 1, wherein the crawl phase is carried out by the drive motor after a true stop at point in time (t2) and prior to the consumption depending subsequent re-start at point in time (t5).

3. Method as in claim 1, wherein the crawl phase is carried out by the drive motor first immediately prior to the point in time (t5) of the consumption depending subsequent re-start (t5).

4. Method as in claim 1, wherein the timewise end (point in time t4, t4', t4") of the crawl phase is adjusted exactly at or shortly after the point in time (t5) of the consumption depending subsequent re-start.

5. Method as in claim 1, wherein the drive motor performs the consumption depending re-start with the previous crawl phase directly continuing into the re-start acceleration, said crawl phase being initiated by a start signal at the point in time (t5), in order to avoid the occurrence of static breakaway friction between the crawl phase and the re-start.

6. Method as in claim 1, wherein weaving pattern depending information either for at least several insertion cycles without any yarn consumption or for subsequent insertion cycles with yarn consumption is provided in advance, wherein said information is transmitted to the control device, and the control device initiates the crawl phase prior to or exactly at the consumption depending subsequent re-start of the previously stopped drive motor on the basis of the transmitted information.

7. Method as in claim 6, characterized in that the timewise or rotation angle related and (point in time t4, t4', t4") of the crawl phase either is set shortly prior to, exactly at, or shortly after the point in time (t5) or the rotation angle value of the consumption depending subsequent re-start of the drive motor (M).

* * * * *